United States Patent [19]

Brandstetter

[11] 4,139,323

[45] Feb. 13, 1979

[54] ROCK ANCHOR

[75] Inventor: Friedrich P. Brandstetter, Salzburg, Austria

[73] Assignee: Gebirgssicherung - Ges.m.b.H., Salzburg, Austria

[21] Appl. No.: 779,897

[22] Filed: Mar. 21, 1977

[30] Foreign Application Priority Data

Jun. 1, 1976 [DE] Fed. Rep. of Germany ..... 2624559

[51] Int. Cl.[2] ..... E21D 21/00

[52] U.S. Cl. ..... 405/260

[58] Field of Search ..... 61/45 B, 63, 35; 299/10, 11; 52/156, 166, 704, 707

[56] References Cited

U.S. PATENT DOCUMENTS

| | | | |
|---|---|---|---|
| 2,952,129 | 9/1960 | Dempsey | 61/45 B |
| 3,306,051 | 2/1967 | Honlett | 61/45 B |
| 3,379,019 | 4/1968 | Williams | 61/45 B |
| 3,641,772 | 2/1972 | Dietrich | 61/45 B |
| 3,693,359 | 9/1972 | Karara | 61/45 B |
| 3,702,060 | 11/1972 | Cumming | 61/45 B |
| 3,893,303 | 7/1975 | Rotter | 61/45 B |

FOREIGN PATENT DOCUMENTS

| | | | |
|---|---|---|---|
| 1182185 | 11/1964 | Fed. Rep. of Germany | 61/45 B |
| 1288543 | 6/1969 | Fed. Rep. of Germany | 61/45 B |
| 2157896 | 11/1971 | Fed. Rep. of Germany | 61/45 B |
| 84938 | 1/1955 | Norway | 61/45 B |
| 539193 | 8/1973 | Switzerland | 61/45 B |

*Primary Examiner*—Mervin Stein
*Assistant Examiner*—A. Grosz
*Attorney, Agent, or Firm*—Birch, Stewart, Kolasch and Birch

[57] ABSTRACT

A rock anchor assembly comprising a metallic tubular element adapted to be inserted into a bore hole so that one end portion thereof extends a distance from the closed end of the bore hole and the other end portion thereof extends from the opening of said bore hole, said other end portion thereof containing a threaded section for receiving a clamp nut, an anchor plate having a size larger than the bore hole and disposed against the face of said bore hole between the clamp nut and said face, at least one reinforcing element disposed in said tubular element, filling means for introducing the synthetic resin into the bore hole, said synthetic resin holding a reinforcing element in position within said tubular element, and at least one sealing ring disposed around the external surface of the tubular element adjacent said threaded section for sealing the bore hole wall when the head of the rock anchor is introduced into the bore hole.

17 Claims, 4 Drawing Figures

ROCK ANCHOR

BACKGROUND AND SUMMARY OF THE INVENTION

The present invention relates to a rock anchor which utilizes a synthetic resin, especially an epoxy resin, which is cold injected in liquid form under pressure and hardens thereafter.

It is already known to stabilize rock formations by injecting hardenable plastic materials such as a polyester or an epoxy resin in liquid form under pressure and then letting these plastic materials harden. For the injection, an extruder head is placed on the external face of the rock, sealing it and penetrating into the bore hole to be filled. The injected resin in liquid form penetrates into the fissures adjacent to the hole to be filled, so that a "compound" with the rock is achieved (see U.S. Pat. No. 3,260,053).

The disadvantage of such a synthetic resin dowel is that it cannot be tensioned like reinforced concrete anchors. Reinforced concrete anchors, as is already known, consist of a steel rod or pipe introduced into a bore hole and bonded to the bore hole wall with a concrete material which fills the bore hole and becomes solidified. The outward projecting portion of the steel rod or pipe is provided with a thread for screwing a clamp nut thereto, said clamp nut pressing an anchor plate against the rock so that through the screwing of the nut the required tensional force can be generated.

Accordingly, the object of the present invention is to provide a rock anchor such as that described, which can be tensioned.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, the disadvantages of the prior art are solved by providing a rock anchor comprising a metallic tubular element, the extremity of which is threaded for receiving a nut, providing an anchor plate which is pressed against the rock, and providing as a reinforcing element at least one glass fiber-reinforced plastic rod, one end of which is maintained in the metallic tubular element by the addition of a hardened resin thereto with the use of a filler-inlet hole, with the other end extending into the bore hole to a certain depth. In addition, at least one sealing ring is disposed around the metallic tubular element directly at the threaded section, thereby sealing the bore hole wall during the introduction of the anchor head into the bore hole. For practical purposes, the metallic tubular element comprises deformations of its wall protruding beyond the inner surface thereof in order to increase the static friction at the filled-up resin.

The reinforcing elements used for this purpose can be glass fiber-reinforced plastic rods and tubes. The plastic material may be polyester resin or epoxy resin. The glass fiber-reinforced resin rods and tubes are manufactured by the following process. An endless wound glass fiber is cut to portions of the desired length of for instance a glass fiber-reinforced resin rod. The glass fiber portions are grouped to a pack of the desired thickness, the pack is impregnated with an expoxy or polyester resin, and then the pack is pressed or drawn through a correspondingly annular die. After the curing of the pack a glass fiber-reinforced resin rod or tube, respectively, is obtained. In this rod or tube the glass fiber material is predominant, because the epoxy resin or polyester resin merely serves the purpose to bond the glass fiber portions in the pack to each other.

The tube can be provided with air-relief slots at its end situated in the bore hole. As this tube is open at its outward end of the bore hole, the air which has been displaced by the introduction of the liquid resin can escape through this tube which also serves as a reinforcing element. Mountain water which might eventually accumulate inside the bore hole can also flow out through this tube. At the end of the injection process, the tube is filled with liquid resin, and the outflow of the resin from its end situated outside the bore hole indicates that the bore hole is completely filled up.

Besides the glass fiber-reinforced plastic tube, other reinforcing elements can be used, such as glass fiber-reinforced plastic rods. The material of the plastics used for the tube or rods may be a synthetic resin. They are placed and maintained in the metallic tubular element by the hardened synthetic resin, for example, an epoxy resin. The tube and rods are flexible so that they can be more readily used in narrow advance heading rooms, for example, in caps.

To prevent the liquid resin from flowing into rocks joints, a glass-fiber sheath can be placed over the metallic tubular element, for example a steel tube or at least over the section disposed in the bore hole. This web can, according to the need, be used to wrap the reinforcing elements protruding beyond the steel tube inside the bore hole. The size of the mesh apertures of the glass-fiber web or fabric is such that the plastic material cannot flow therethrough; however, under pressure, that is to say at the end of the injection, the web lets the liquid synthetic resin penetrate through in such a way that it can bind itself to the rock. Thus, the glass-fiber web forms also an additional reinforcement of the anchor.

The initial setting time of the epoxy resin which is generally utilized for the injection under pressure ranges from 6 to 8 minutes, while the complete curing time ranges between 20 and 40 minutes. During this time, the reinforcing means with the help of the anchor plate and the screwing device may be tensioned by an optional tensional force because, on one hand, the reinforcing means is fixed in the anchor pipe head by the cured epoxy resin and on the other hand, the injected epoxy resin first cures at the end of the bore hole, since in this location it will at first be at rest and harden. After this period of hardening, e.g., about 40 minutes, the anchor can be tensioned by the screwing device. Thanks to the sealing rings disposed around the steel pipe which sealingly contact the bore hole wall, a flowing out of the injected resin between the external face of the steel pipe and the internal wall of the bore hole is prevented.

The advantage of the rock anchor according to the present invention is that it permits the pretensioning and stressing of the anchor filled with synthetic resin due to the screw thread, the plate and the clamp nut. Furthermore, it is maintained and sealed in the bore hole by the sealing rings and, finally, the anchor transfers the tensile stress of the tensioning device to the glass-fiber reinforcing means and the filled synthetic resinous materials due to the indentations along the length of the anchor pipe which increase the static friction. Thus, during filling and before hardening, the anchor pipe head together with the inserted reinforcing means and the filled in synthetic resin is better held and fixed in the bore hole also when positioned overhead, and no support is necessary. Because of the indentations of the pipe, the anchor pipe head held without support does not only resist against the injection pressure, but also the static friction between the anchor pipe head and the filling material is increased to such an extent that a high tensile and pretensioning force can be transferred to the reinforcement.

BRIEF DESCRIPTION OF THE DRAWINGS

The present invention will become more fully understood from the detailed description given hereinbelow and the accompanying drawings which are given by way of illustration only, and thus are not limitative of the present invention: and wherein.

DESCRIPTION OF THE PREFERRED EMBODIMENTS

Figure 1:
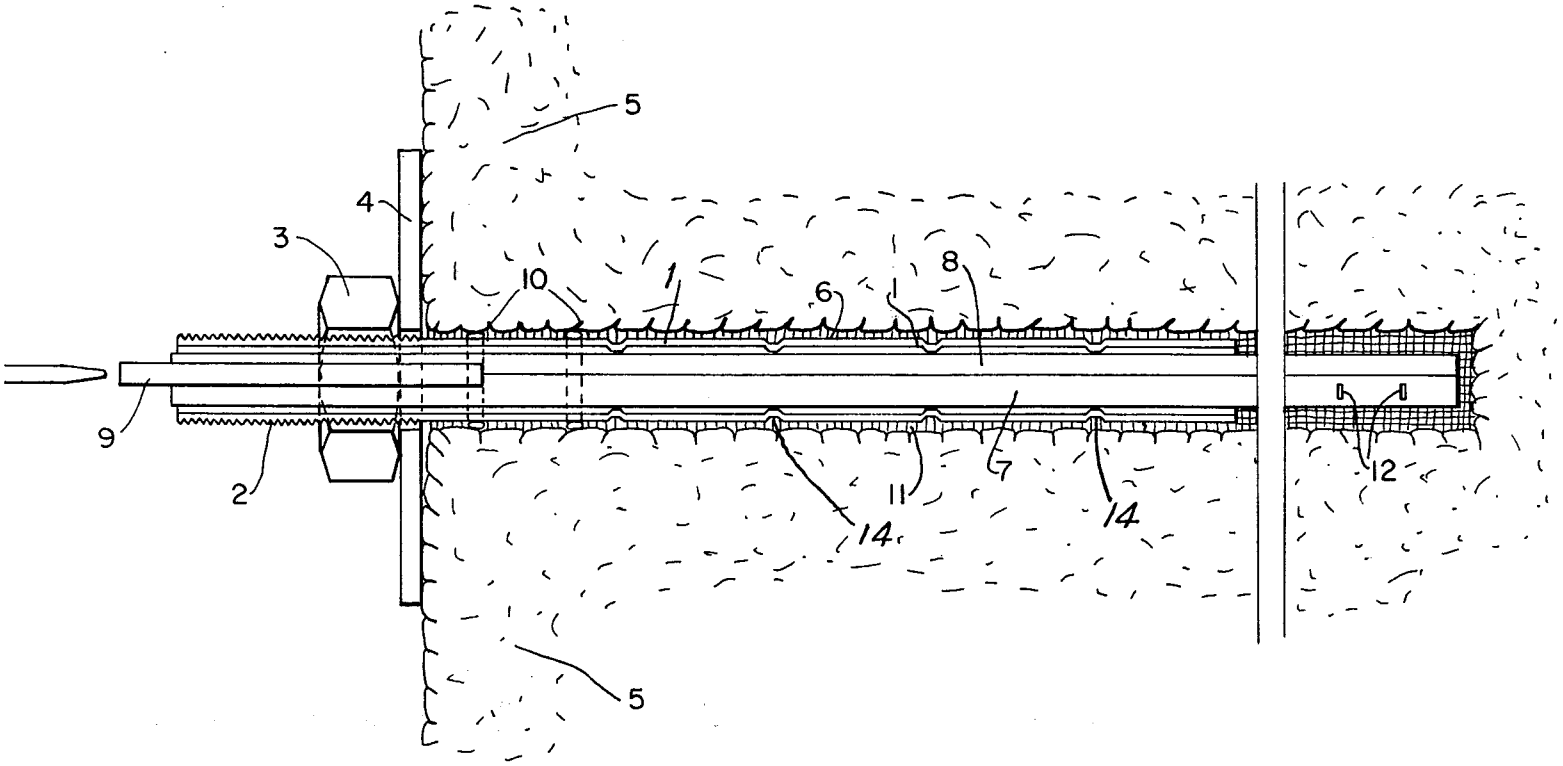
FIG. 1 shows the utilization of a rock anchor in longitudinal section.

The rock anchor as shown in the drawings is composed of a steel tube 1 having a threaded section 2 on which a clamp nut 3 is screwed. The clamp nut presses an anchor plate 4 against the rock 5 surrounding the bore hole 6, so that a sliding of the anchor plate 4 along the steel pipe 1 is achieved. Furthermore, indentations are squeezed into the steel tube in some places in order to increase the friction while the tube is resting in the bore hole so that it is readily maintained over the head during the filling-up operation without being pressed into the bore hole. As shown in the figures, a single tube 7 made of glass fibers and a synthetic resin and two rods 8 made of glass fibers and a synthetic resin are placed in the steel tube as already described, and are held therein by the hardened synthetic resin 20, such as for example, an expoxy resin. The tube 7 and the rods 8 extend through the steel tube 1 so that the tube 7 is opened at its end situated outside the bore hole 6. A small filler inlet hole is provided in which a short pipe 9 is placed for introducing the epoxy resin which fills the steel tube and fixes the reinforcing elements, i.e., the tube 7 and rod 8 in place. Around the steel tube 1 and adjacent to the threaded section 2, two sealing rings 10 are disposed spaced from each other, thereby sealing the internal wall of the bore hole. Furthermore, the steel tube 1 is coated with a glass-fiber sheath 11 adjacent to the threaded section 2. The sheath 11 extends over the steel tube on the inside of the bore hole, thereby coating the reinforcing elements 7 and 8.

First, an anchor head composed of the reinforcing elements 7 and 8 and the metallic tubular element 1 is introduced with the glass-fiber web 11 into the bore hole having been previously drilled and eventually cleaned. Then the liquid resin is injected under pressure into the bore hole through the filling pipe or opening 9. The air displaced inside the bore hole can escape through the air-relief slots 12, which have been provided for in that part of the tube 7 situated at the end of the bore hole. During the filling operation, the anchor head is also maintained in the bore hole 9 over the head and without the need of support due to the several squeezed portions 14 of the steel tube which increase the static friction thereof.

The liquid resin penetrates the glass-fiber web 11 in such a way that a connection between the synthetic resin and the internal face of the bore hole is produced, but the penetration of the resin into the rock joints, clefts or gaps in the rock, is avoided. At the same time, the liquid synthetic resin penetrates through the length of the tube 7 so that, when it comes out at the open end of the tube 7, it can be noticed that the bore hole is completely filled. During the hardening of the synthetic resin, a solid and strong connection between the reinforcing elements 7 and 8, the glass-fiber web 11 and the internal face of the wall is produced. Immediately afterwards, the anchor plate 4 can be set up and pressed against the rock 5 with the help of the clamp nut 3, so that in screwing the nut 3 according to the method described above, the anchor can be put under tensile stress.

Figure 3:
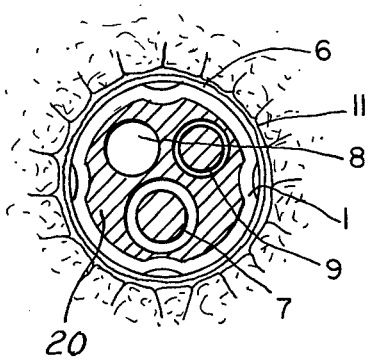
FIG. 3 is a cross section of a second embodiment of the rock anchor of the present invention.
Figure 2:
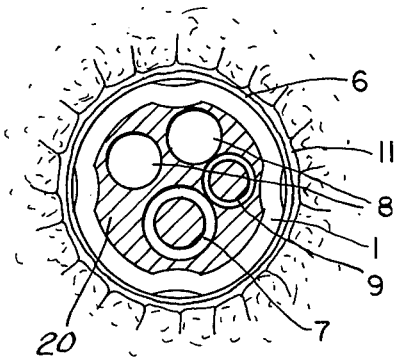
FIG. 2 is a cross section of the rock anchor of FIG. 1.

Whereas two glass fiber and synthetic resin rods 8 and one glass fiber and synthetic resin pipe 7 are provided as reinforcing elements for the embodiment shown in FIGS. 1 and 2, only one rod 8 and one pipe 7 are provided in the embodiment of FIG. 3. The filling pipe which is also filled with hardened resin remains in the steel pipe 1.

Figure 4:
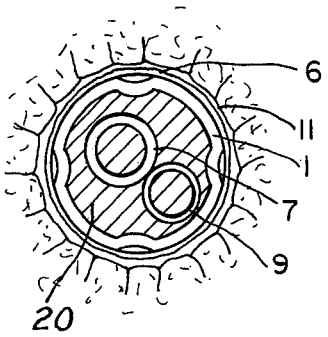
FIG. 4 is a cross section of a third embodiment of the rock anchor of the present invention.

For the embodiment shown in FIG. 4, only one central tube made of glass fiber and synthetic resin is utilized as a reinforcing element, as well as the short filling pipe or filling opening.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A rock anchor assembly comprising:

a metallic tubular element adapted to be inserted into a bore hole so that one end portion thereof extends a distance from the closed end of the bore hole and the other end portion thereof extends from the opening of said bore hole, said other end portion thereof containing a threaded section for receiving a clamp nut;

an anchor plate having a size larger than the bore hole and abutting against the face of said bore hole between the clamp nut and said face;

at least one reinforcing element disposed in said tubular element, said reinforcing element comprising a resin bonded glass fiber member;

filling means for introducing a curable plastic material into the bore hole, said plastic material holding the reinforcing element in position within said tubular element;

at least one sealing ring disposed around the external surface of the tubular element adjacent said threaded section for sealing the bore hole wall when the head of the rock anchor is introduced into the bore hole;

said tubular element extending a short distance from the open end of the bore hole and the reinforcing member extending beyond said tubular element into close proximity to the end of said bore hole;

said external surface of the metallic tubular member being indented in certain locations to increase the static friction between said metallic tubular member and said plastic material filled therein; and a sheath surrounding the tubular element and a portion of the reinforcing element, said sheath being positioned within the borehole.

2. The rock anchor assembly of claim 1, wherein the plastic material filled into the bore hole and the metallic tubular element is a synthetic resin.

3. The rock anchor assembly of claim 1, wherein the reinforcing element is a glass fiber-synthetic resinous tube.

4. The rock anchor assembly of claim 3, wherein the reinforcing resinous tube contains air relief slots disposed in that end portion which extends into the bore hole.

5. The rock anchor assembly of claim 1, wherein the reinforcing element comprises a glass fiber-synthetic resinous tube and at least one glass fiber-synthetic resinous rod.

6. The rock anchor assembly of claim 1, wherein the filling means is a short inlet pipe.

7. The rock anchor assembly of claim 1, wherein the sheath is a glass fiber sheath.

8. The rock anchor assembly of claim 1, wherein an epoxy resin holds the reinforcing element in the tubular element.

9. A rock anchor assembly comprising:

a metallic tubular element adapted to be inserted into a bore hole so that one end portion thereof extends a distance from the closed end of the bore hole and the other end portion thereof extends from the opening of said bore hole, said other end portion thereof containing a threaded section for receiving a clamp nut;

an anchor plate having a size larger than the bore hole and abutting against the face of said bore hole between the clamp nut and said face;

at least one reinforcing element disposed in said tubular element, said reinforcing element comprising a resin bonded glass fiber rod;

filling means for introducing a curable plastic material into the bore hole, said plastic material holding the reinforcing element in position within said tubular element;

at least one sealing ring disposed around the external surface of the tubular element adjacent said threaded section for sealing the bore hole wall when the head of the rock anchor is introduced into the bore hole; and said reinforcing element further comprising a tube including at least one air relief slot disposed adjacent the end portion which extends into the bore hole.

10. The rock anchor assembly of claim 9, wherein the tubular element extends a short distance from the open end of the bore hole and the reinforcing member extends beyond said tubular element into close proximity to the end of said bore hole.

11. The rock anchor assembly of claim 9, wherein the outer surface of the metallic tubular member is indented in certain locations to increase the static friction between said metallic tubular member and said plastic material filled therein.

12. A method of installing a rock anchor to a wall, said rock anchor including a metallic tubular element provided with a threaded portion at one end, at least one reinforcing element disposed therein, said reinforcing element comprising a resin bonded glass fiber member, an anchor plate and a clamp nut, comprising:

making a bore hole in the wall;

introducing the metallic tubular element containing the reinforcing element into said bore hole so that the threaded portion extends out of the bore hole, said reinforcing element including a tube containing air-relief slots adjacent the end portion which extends into the bore hole;

introducing a hardenable plastic material under pressure into the bore hole, the air inside said bore hole being permitted to escape through said air-relief slots, said plastic material penetrating through the length of the tubular element until if flows out the open end thereof;

permitting the plastic material to harden; and placing the anchor under tensile stress by pressing the anchor plate against the face of the bore hole by screwing the clamp nut on the tubular member against the anchor plate.

13. The method of claim 12, wherein the metallic tubular element is surrounded with a glass fiber web when positioned into the bore hole, said hardenable plastic material penetrating the glass fiber web in such a way that a connection between the plastic material and the internal face of the bore hole is produced without causing the plastic material to penetrate into the rock joints, wherein during the hardening of the plastic material a solid connection is achieved between the reinforcing element, the glass fiber web and the internal face of the bore hole wall.

14. The method of claim 12, wherein the hardenable plastic material is a curable synthetic resin.

15. The method of claim 12, wherein the reinforcing element is a glass fiber-reinforced synthetic resinous tube.

16. The method of claim 15, wherein the reinforcing element further includes a glass fiber-reinforced synthetic resinous rod.

17. A rock anchor assembly comprising:

a metallic tubular element adapted to be inserted into a bore hole so that one end portion thereof extends a distance from the closed end of the bore hole and the other end portion thereof extends from the opening of said bore hole, said other end portion thereof containing a threaded section for receiving a clamp nut;

an anchor plate having a size larger than the bore hole and abutting against the face of said bore hole between the clamp nut and said face;

at least one reinforcing element disposed in said tubular element;

filling means for introducing a curable plastic material into the bore hole, said plastic material holding the reinforcing element in position within said tubular element;

at least one sealing ring disposed around the external surface of the tubular element adjacent said threaded section for sealing the bore hole wall when the head of the rock anchor is introduced into the bore hole; and said reinforcing element comprising a glass fiber-synthetic resinous tube including air relief slots disposed adjacent the end portion which extends into the bore hole and at least one glass fiber-synthetic resinous rod.

* * * * *